US005657602A

United States Patent [19]

Hellander

[11] Patent Number: 5,657,602

[45] Date of Patent: Aug. 19, 1997

[54] EXTERIOR WALL SYSTEM AND METHOD OF CONSTRUCTING SAME

[76] Inventor: Leif H. B. Hellander, Bjornbarsgatan 3, Lomma 23443, Sweden

[21] Appl. No.: 597,295

[22] Filed: Feb. 6, 1996

[51] Int. Cl.[6] ..... E04B 1/74

[52] U.S. Cl. ..... 52/446; 52/407.1; 52/406.2; 52/404.4; 52/309.11; 52/586.1; 52/444; 52/445; 52/407.2; 52/447; 52/449; 52/506.01

[58] Field of Search ..... 52/367, 368, 369, 52/586.1, 404.1, 406.1, 406.2, 407.2, 404.4, 464, 662, 309.11, 407.1, 407.4, 444, 445, 446, 449, 585.1, 605, 582.1, 506.01; 528/934, 935, 451

[56] References Cited

U.S. PATENT DOCUMENTS

| | | | |
|---|---|---|---|
| 1,524,938 | 2/1925 | Makowski | 52/445 |
| 1,524,939 | 2/1925 | Makowski | 52/445 |
| 2,835,938 | 5/1958 | McElroy | 52/586.1 |
| 3,284,980 | 11/1966 | Dinkel | 52/367 |
| 3,336,709 | 8/1967 | Berney et al. | 52/404.1 X |
| 4,080,767 | 3/1978 | Wilhelm | 52/444 X |
| 4,578,915 | 4/1986 | Schneller | 52/446 X |
| 4,694,624 | 9/1987 | Juhas | 52/404.1 X |
| 4,811,537 | 3/1989 | D'Epenoux | 52/404.1 X |
| 4,852,316 | 8/1989 | Webb | 52/235 |
| 4,882,888 | 11/1989 | Moore | 52/404.1 X |
| 5,245,809 | 9/1993 | Harrington | 52/309.11 |
| 5,349,796 | 9/1994 | Meyerson | 52/309.11 |
| 5,351,454 | 10/1994 | Höhne et al. | 52/309.11 X |
| 5,564,243 | 10/1996 | Kroll et al. | 52/506.1 |

FOREIGN PATENT DOCUMENTS

| | | | |
|---|---|---|---|
| 17382 | 12/1928 | Australia | 52/444 |

*Primary Examiner*—Wynn E. Wood
*Assistant Examiner*—W. Glenn Edwards
*Attorney, Agent, or Firm*—Watson Cole Stevens Davis, P.L.L.C.

[57] ABSTRACT

An exterior wall system for a side of a building includes a plurality of prefabricated composite panels which are positioned in courses above an elongated support bracket attached to a support structure of the building, the composite panels being connected to the building support structure by fasteners which extend through washers that each extend in part into grooved channels in the sides of abutting panels from adjacent courses. The courses of panels are covered by a seamless layer of a hardened mixture of binder and aggregate material such as marble.

13 Claims, 2 Drawing Sheets

EXTERIOR WALL SYSTEM AND METHOD OF CONSTRUCTING SAME

BACKGROUND OF THE INVENTION

1. Field of the Invention

The invention relates to an exterior wall system for a building, e.g., a fascade structure covering a side structure of a building, and to a method for constructing such an exterior wall system.

2. The Prior Art

Many different types of fascade structures for buildings and techniques for their construction are known and in current use. Reference can be made to U.S. Pat. No. 4,044,520 (Barrows), U.S. Pat. No. 4,481,705 (Fuhrer) and U.S. Pat. No. 5,367,847 (Hepler). However, the known structures and techniques for their construction are rather expensive insofar as they are very time consuming to install and often require highly skilled workers. This limits their applicability.

The present invention is directed to an improved exterior wall system and construction technique which is easily accomplished by unskilled people (laymen).

SUMMARY OF THE INVENTION

According to the present invention the exterior wall system includes prefabricated composite panels which are formed of a backing board of insulating material and a surface layer of a hardened mixture of binder and particulate material, each composite panel including narrow grooved channels in its sides. During construction of the exterior wall system these composite panels, which are preferably rectangular in shape, are positioned in generally horizontal courses above a support bracket attacked to the side structure of the building. The building side structure can be a layer of plywood attached to the vertical studs of the building or the vertical studs themselves.

The composite panels are glued to one another and they are also fastened to the building side structure by fastening means that include washers and elongated fasteners. Each washer extends in part into a grooved channel of one composite panel and in part into a grooved channel of an adjacent composite panel, e.g., in an adjacent course, and the elongated fasteners extend through the washers and into the side structure of the building so as to fixedly position the composite panels against the side structure. After all the composite panels have been positioned in place, the seams therebetween are filled with filler compound and taped to provide a smooth surface, and a seamless exterior layer of hardened acrylic latex and aggregate is formed thereover. The so-provided exterior wall system is durable and. attractive, and not only easy to construct but inexpensive.

Further features and advantages of the invention will become apparent by reference to the accompanying drawings, taken in conjunction with the following discussion.

DETAILED DESCRIPTION OF THE PREFERRED EMBODIMENT

Figure 1:
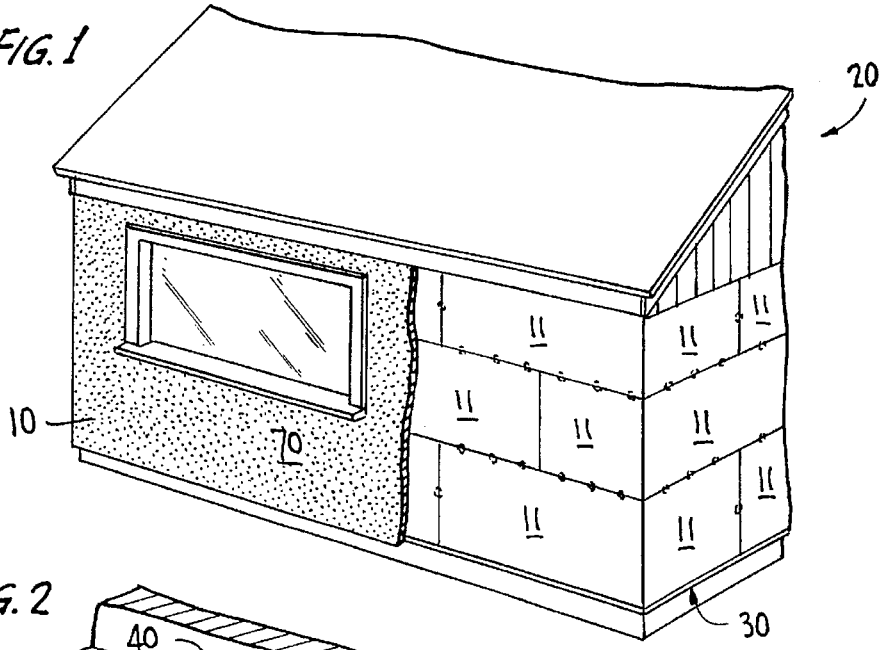
FIG. 1 is a perspective view of a part of a building whose sides are formed by an exterior wall system according to the present invention, part of the exterior layer of the exterior wall system being broken away to show the underlying composite panels.
Figure 2:
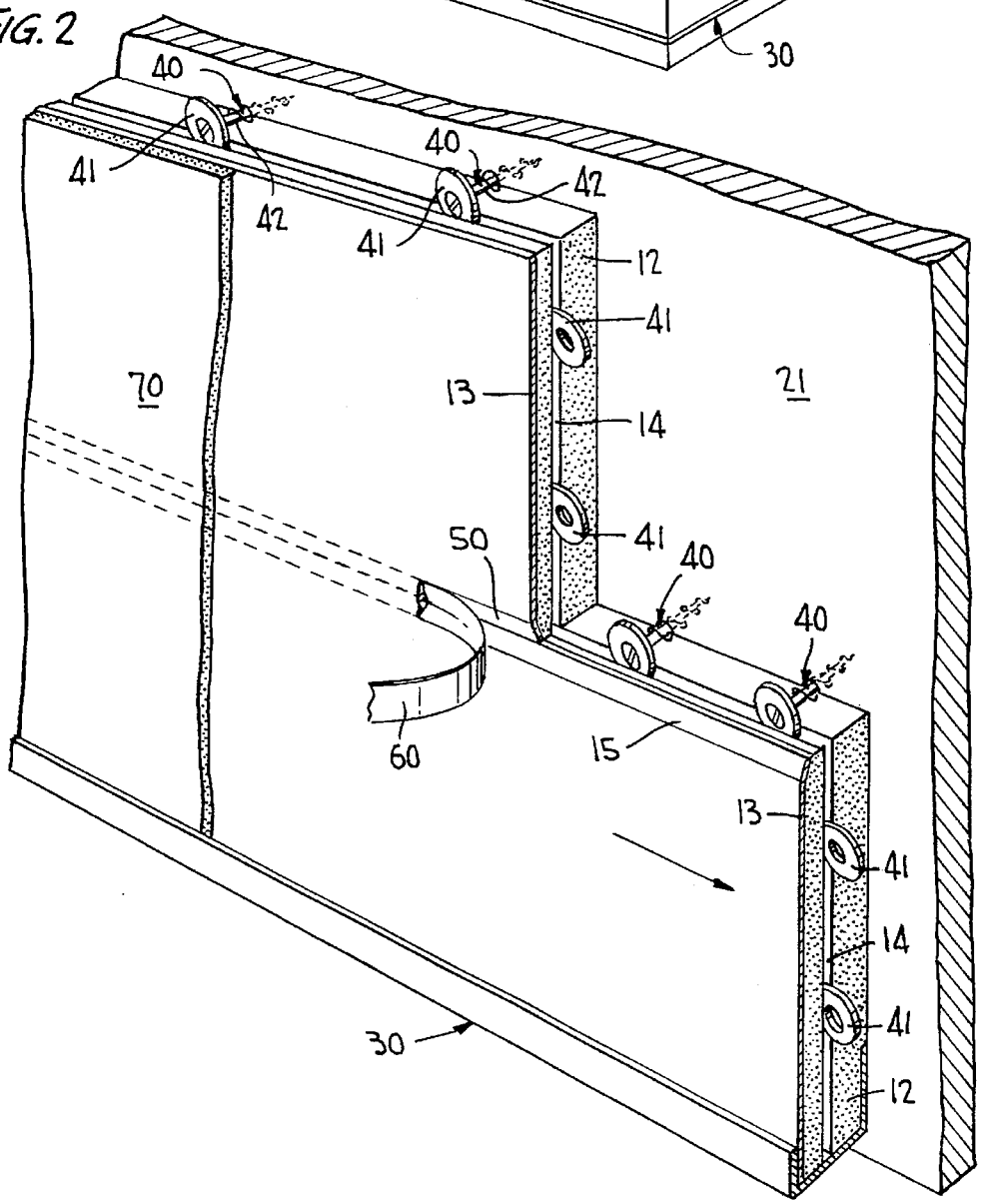
FIG. 2 shows, on an enlarged scale, a perspective view of the inventive exterior wall system and its attachment to a side wall of a building, part of exterior layer of the exterior wall system being broken away.

An exterior wall system 10 according to the present invention which is capable of forming the exterior sides of a building 20 (see FIG. 1), is best understood by reference to FIG. 2. It includes a plurality of prefabricated rectangular composite panels 11 which are positioned in side-by-side relationship and in horizontal courses, one above the other, to form a fascade structure exterior to a side wall 21, the first or lowermost course being positioned on an elongated support bracket 30 which is attached to the side wall 21 by attachment means 31. Each prefabricated composite panel is formed of a rigid backing board 12 made of an insulating material such as extruded polystyrene or styrofoam, and a front layer 13 composed of a hardened mixture of latex binder and particulate material such as crushed marble, powdered sand, acrylic particles, cementos and/or glass fiber strands. Each prefabricated composite panel is preferably 2 feet in width and 8 feet in length, and includes a narrow grooved channel 14 along its sides as well as a beveled edge 15 in its front along all four sides thereof.

In a preferred method of constructing the inventive exterior wall system, the elongated support bracket 30 is first of all fastened at or near the bottom of the side wall 21 by the attachment means 31 (which can be screws, nails or rivets), i.e., such that the support bracket extends generally horizontally. Then a first composite panel 11, which has been coated with glue over its sides, is positioned on the support bracket at one end of the support bracket so as to begin the first course of composite panels. In order to fixedly position this composite panel in place, washers 41 of a plurality of fastening means 40, preferably six, are partially extended into the narrow grooved channel along the upper horizontal side of the first composite panel, and an associated elongated fastener 42 is extended through the respective washers and into the side wall 21, and preferably into a stud therebehind, to tighten the composite panel against the side wall. The washers have countersunk holes therein such that the heads of the fasteners will become recessed therein. Thereafter, one or more washers 41 are partially extended into the narrow grooved channel along the vertical side of the composite panel where the next composite panel is to abut (the washers have thicknesses such that they will remain in place), and a second composite panel, to which glue has been applied to its sides, is positioned on the support bracket and against the adjacent side of the first composite panel, such that the washers 41 extending from the side of the first composite panel will partially extend within the corresponding grooved channel of the abutting side of the second composite panel, thereby aligning the two composite panels. The two composite panels will become glued together. Fastening means 40 are then installed along the upper horizontal side on the second composite panel and washers 41 are partially positioned in the opposite vertical side of the second composite panel in the same fashion as with the first composite panel. Additional composite panels are sequentially positioned in side-by-side relationship and glued together until the first course is completed. Since the composite panels are easily cut with a saw, the last panel in the first course can be cut to a desired horizontal dimension prior to installation. Indeed, if desired, the terminal sides of the first and last composite panels in each course can be suitably cut, such as at a 45° angle, to properly abut with corresponding composite panels covering adjacent side walls of the building.

Upon completion of the first course, the second course is installed thereabove. In this regard, the first composite panel for the second course, which has been cut to a horizontal dimension one half that of the first composite panel of the first course so that the vertical sides of the composite panels in the second course will be offset in a brickwork-like fashion from those of the first course, and which has been covered with glue along its sides, is positioned above the first composite panel of the first course such that washers 41 of fastening means 40 will extend into the grooved channel in its lower horizontal side. Then fasteners 40 will be installed along its upper horizontal side to tighten it against the side wall 21. Washers 41 are installed in its vertical side where the next composite panel is to abut, and the technique continued until all the composite panels for the second course, and indeed for all the courses, is completed. Of course, the composite panels are cut to accommodate windows, doors and other openings in or protuberances extending outwardly of the side wall 21.

After all the courses of composite panels have been completed, a filler compound 50, e.g., spackle, is filled in the seams provided between the composite panels by the beveled edges 15, a tape 60 such as fiberglass tape is applied over the filler compound, and additional filler compound is applied over the tape and fanned so as to provide a very smooth surface. Finally, a mixture of binder such as acrylic latex and an aggregate such as crushed marble is spread over the joined composite panels, such as by using a roller or a trowel, to provide an attractive, seamless, weather-resistant exterior layer 70, thus completing the exterior wall system.

Figure 3:
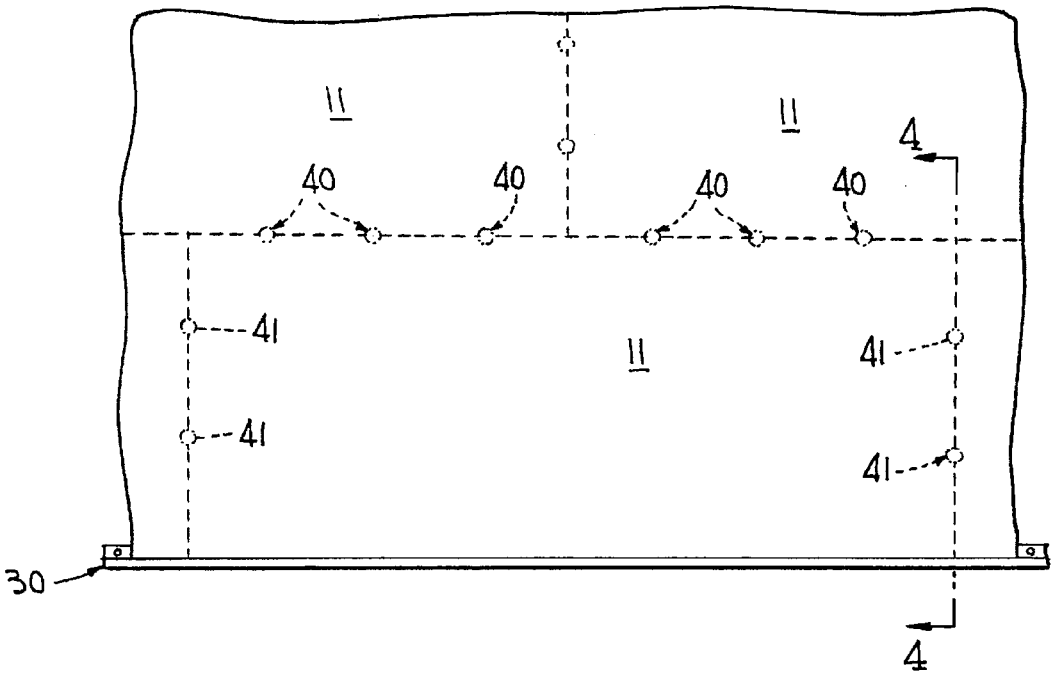
FIG. 3 illustrates a plurality of adjacent composite panels positioned on a support bracket and fastening means attaching them to an underlying wall.
Figure 4:
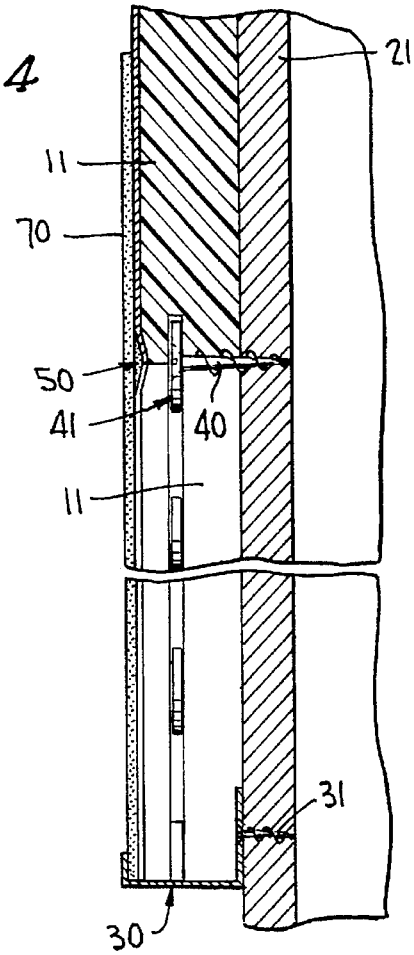
FIG. 4 is a sectional view of FIG. 3 as seen along line 4—4

It should be noted that the number of fastening means 40 installed along the upper sides of the composite panels in a course will depend on the horizontal dimension of the composite panels, but in any event at least three (see FIG. 3) will be employed in cooperation with each composite panel in the course thereabove. In addition, although it is only necessary to employ washers 41 between adjacent composite panels in a course for purposes of alignment, it is possible to extend fasteners 42 therethrough and into the side wall 21 for improved attachment of the respective composite panels to the side wall.

It should also be noted that, in the event the inventive exterior wall system is being attached to vertical studs of the building itself, the fastening means 40 will necessarily be spaced so as to attach to such studs.

The inventive exterior wall system is durable and seamless, and it can be constructed by relatively unskilled laborers.

Although a preferred embodiment of the invention has been shown and described, changes therein can be made and still fall within the scope of the appended claims.

I claim:

1. A prefabricated composite panel for use in constructing an exterior wall system for a building, said composite panel defining a plurality of sides and comprising a backing board of insulating material and front layer in contact with the backing board, said front layer being made of a hardened mixture of latex and a particulate material, said backing board including a grooved channel in each of the sides thereof.

2. The prefabricated composite panel of claim 1, wherein said insulating material is selected from the group consisting of extruded polystyrene and styrofoam.

3. The prefabricated composite panel of claim 2, wherein said particulate material is selected from the group consisting of crushed marble, powdered sand, acrylic particles, cementos and glass fibers.

4. The prefabricated composite panel of claim 3, wherein said composite panel is rectangular and includes beveled edges along all four sides of a front surface thereof.

5. An exterior wall system for a building which comprises:

a plurality of prefabricated rectangular composite panels which are positioned in side-by-side fashion in a plurality of horizontal courses, each prefabricated composite panel defining a plurality of sides and comprising a backing board of insulating material and a front layer of a hardened mixture of latex and a particulate material, each backing board including a grooved channel in each side thereof;

fastening means connecting said composite panels to an underlying support structure, said fastening means comprising washers which extend into grooved channels of abutting composite panels in adjacent courses and elongated fasteners which respectively extend through said washers and into said support structure; and a continuous exterior layer of hardened latex binder and aggregate material covering said courses of composite panels.

6. A method of constructing an exterior wall system relative to a support structure of a building which comprises the steps of: (a) attaching a support bracket to said building support structure so as to be generally horizontally oriented, (b) providing a plurality of prefabricated rectangular composite panels, each composite panel defining a plurality of sides and including a backing board of insulating material and a surface layer of a hardened mixture of latex binder and particulate material, each backing board including a grooved channel in each of the sides thereof, (c) positioning a first of said plurality of composite panels on said support bracket, (d) fastening said first composite panel to said support structure, (e) positioning a second of said plurality of composite panels on said support bracket, (f) attaching said second composite panel to said first composite panel and to said building support structure, (g) sequentially positioning additional composite panels of said plurality of composite panels on said support bracket and sequentially attaching said additional composite panels to prior positioned composite panels and to said building support structure to complete a first course of composite panels, (h) providing additional courses of composite panels above said first course, (i) sealing and taping all joints between adjacent composite panels, and (j) forming a hardened coating of a mixture of binder and aggregate material over said courses of composite panels to provide a durable, seamless exterior layer thereover.

7. A method according to claim 6, wherein in step (d) said first composite panel is fastened to said existing side wall by positioning a washer of a fastening means partially in a grooved channel in an upper side thereof and extending a fastener of the fastening means through said washer and into said building support structure.

8. A method according to claim 7, wherein in step (f) said second composite panel is glued to said first composite panel.

9. A method according to claim 8, wherein in step (f) said second composite panel is also secured to said support structure by positioning a washer of a fastening means partially in a grooved channel in an upper side thereof and extending a fastener of the fastening means through said washer and into said building support structure.

10. A method according to claim 9, wherein in step (g) said additional composite panels are sequentially attached to prior positioned composite panels with glue.

11. A method according to claim 6, including steps (d) and (e) a step ($d^1$) of positioning a washer to partially extend a grooved channel in a vertical side of said first composite panel where a second composite panel is to abut, and wherein in step (f) said second composite panel is moved against said first composite panel such that said washer extends into the grooved channel in the abutting vertical side of said second composite panel.

12. The prefabricated composite panel of claim 1 which consists of said backing board of insulating material and said front layer.

13. The exterior wall system of claim 5, wherein each of said prefabricated composite panels consists of said backing board of insulating material and said front layer.

* * * * *